United States Patent [19]

Bock et al.

[11] 4,430,943

[45] Feb. 14, 1984

[54] FIN-STABILIZED PROJECTILE HAVING A SABOT BASE AND FORMING A PRACTICE PROJECTILE

[75] Inventors: Erich Bock, Nuremberg; Wolfgang Mosig, Hartmannshof, both of Fed. Rep. of Germany

[73] Assignee: Diehl GmbH & Co., Fed. Rep. of Germany

[21] Appl. No.: 286,617

[22] Filed: Jul. 24, 1981

[30] Foreign Application Priority Data

Jul. 26, 1980 [DE] Fed. Rep. of Germany ..... 3028378

[51] Int. Cl.[3] ..... F42B 5/22

[52] U.S. Cl. ..... 102/522; 102/529

[58] Field of Search ..... 102/430, 444, 439, 501, 102/502, 513, 520–523, 498, 506, 517–519, 529

[56] References Cited

U.S. PATENT DOCUMENTS

| | | | |
|---|---|---|---|
| 3,672,304 | 6/1972 | Rogers et al. | 102/501 X |
| 4,165,692 | 8/1979 | Dufort | 102/529 X |

FOREIGN PATENT DOCUMENTS

| | | | |
|---|---|---|---|
| 2420116 | 3/1978 | France . | |
| 4297 | of 1894 | United Kingdom | 102/501 |
| 1538192 | 1/1979 | United Kingdom . | |
| 1562021 | 3/1980 | United Kingdom . | |
| 2080926 | 2/1982 | United Kingdom | 102/522 |

*Primary Examiner*—Harold J. Tudor
*Assistant Examiner*—Tyrone Davis
*Attorney, Agent, or Firm*—Scully, Scott, Murphy & Presser

[57] ABSTRACT

A fin-stabilized projectile having a sabot which forms a practice projectile with a sub-caliber projectile including a sabot whose base includes a passageway for propellant charge gases and a projectile component which is displaceable by the gases.

7 Claims, 3 Drawing Figures

FIN-STABILIZED PROJECTILE HAVING A SABOT BASE AND FORMING A PRACTICE PROJECTILE

BACKGROUND OF THE INVENTION

1. Field of the Invention

The present invention relates to a fin-stabilized projectile having a sabot base which forms a practice projectile with a sub-caliber projectile including a sabot whose base includes a passageway for propellant charge gases and a projectile component which is displaceable by the gases.

2. Discussion of the Prior Art

From German Laid-open patent application No. 26 03 830 there has become known a projectile having a sabot base which forms a practice projectile in which the sub-caliber projectile is encompassed, on the one side, by the sabot base and, on the other side, by a dome. Passageways for the propellant gases are provided in the base of the cartridge case. The propellant gas passes through these passageways into a hollow chamber in the tip of the dome and causes the dome to be separated from the sabot base projectile while it is still located within the launching or weapon barrel. Due to the dome being prematurely released within the launch barrel, the gas backlash extending through the passageways can adversely influence the initial starting conditions of the projectile. In order to restrict the flight trajectory, this ammunition can be formed with a forward end surface which extends perpendicular to the longitudinal axis, in essence, the fins can be so designed for a spin-stabilized projectile that they will reduce the projectile rotation to such an extent within the intended practice range that the rotational speed necessary for stable flight at the end of the practice range will have fallen short and the sub-caliber projectile will then fly further in an unstable manner with an increased air resistance and a correspondingly shortened range. These measures cannot be imparted to a tubular projector due to its being another type of projectile.

SUMMARY OF THE INVENTION

Accordingly, it is an object of the present invention to provide a tubular practice projectile whose internal and external ballistics substantially correspond to those of a combat projectile but which, however, only requires a relatively small safety range.

The foregoing object of the invention is achieved in that within the cartridge casing base there is guided a piston which is fastened to the sabot base and drivable by the propellant charge gas, and which supports the projectile. The sabot base, piston and projectile in the starting position thereof are fixed with respect to each other through the intermediary of coupling elements, and in which the projectile is separable from the piston.

Hereby it is advantageous that the internal ballistic which is important for the weapon function corresponds to that of combat projectile. Accordingly, there are present specific relationships with regard to the gas pressure and the weapon recoil. It is important for the invention that the necessarily heavy fin head required for a fin-stabilization be located directly on the sabot base, or through intermediary of the piston on the cartridge casing base, and consequently there is afforded the undamaged condition of the projectile during the acceleration within the launching barrel. As a result there are thus precluded any projectile deformations.

Through the present invention there is also ensured that the piston will first effectuate its axial displacement only during or subsequent to the exit of the projectile from the barrel, which initiates the separation of the projectile from the sabot base or from the piston. Within the launching barrel the projectile remains unchanged with respect to its length. Only during or after exit is the length thereof changed. The location of the center of gravity of the projectile thus remains stable during traversing of the barrel.

The two-part construction of the projectile effects the ensured detachment of the projectile from the piston and the known early closing effect of the barrel cross-section on the air. Herewith the short flight path of the projectile is shortened still further.

BRIEF DESCRIPTION OF THE DRAWINGS

Reference may now be had to an exemplary embodiment of the invention, taken in conjunction with the accompanying drawings; in which.

DETAILED DESCRIPTION

Figure 1:
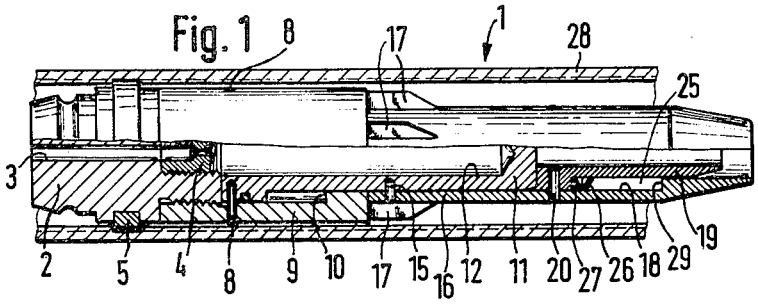
FIG. 1 illustrates the projectile in a partially sectioned longitudinal view during the acceleration phase within a weapon or launch barrel.
Figure 2:
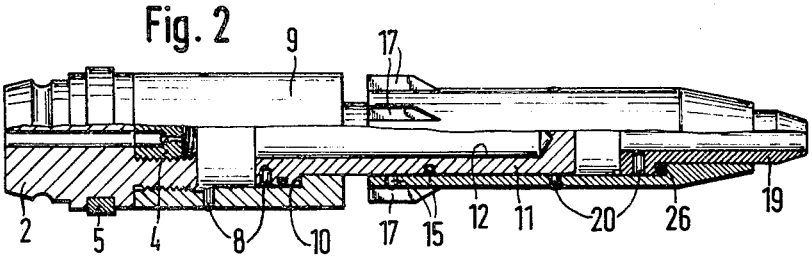
FIG. 2 illustrates the projectile of FIG. 1 after firing from the launch barrel.
Figure 3:
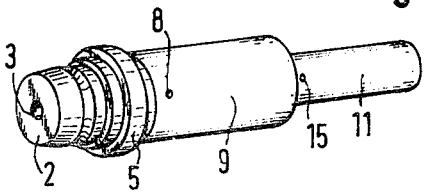
FIG. 3 illustrates a perspective view of the projectile during flight subsequent to detachment from the sabot base.
Figure 3:
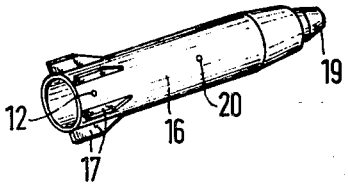

The spin-stabilized practice projectile 1 consists of the sabot base 2 with a passageway 3, a gas reduction nozzle 4, a guide ring 5, a cylindrical sleeve 9 with an end stop 10 which is screwed on and secured through shear pins 8, a piston 11 with recess 12 which is guided within the cylindrical sleeve 9, a projectile shell 16 with stabilizing fins 17 which is connected with the piston 11 through shear pins 15, and a tubular projectile head 19 and guided within a recess 18 in the projectile shell 16, which is fixed therein with shear pins 20 and bounds an internal space 25 relative to the projectile shell 16, in which there is displaceably supported a latching element formed from collar 26 adjacent to collar 27, which together form a stop for the projectile head 19.

The function of the practice projectile consists of in that during the acceleration phase within the launch barrel 28, propellant charge gas will already pass into the recess 12; however, the pressure of the gas will only first effect during or subsequent to the exit of the projectile 1 from the launch barrel, in essence at the termination of the acceleration phase, that the shear pins 8, 15 will be ruptured by the piston 11 which is accelerated in the direction of flight. The piston 11 then jerkily accelerates the projectile head 19 so that the projectile shell 16, due to its inertia, will remain at the cylindrical sleeve 9. At the impact of the projectile head 19 and the deformation of the latching element 26 against the surface 28, the projectile shell 16 together with the projectile head 19 is pulled off from the piston 11. The sabot base will then drop down rapidly. The tubularly-shaped projectile head 19 which projects outwardly with respect to the projectile shell 16 increases the outer contour so as to enhance flow conditions.

In addition thereto, coming into play the known "choke effect" through which the projectile evidences an increased flow resistance.

Through the material which is selected for the projectile head 19, such as sintered iron or glass-hard (brittle) steel, as well as an aluminum alloy having a low tensile strength for the projectile sleeve, there is afforded that these will fracture or deform upon impact against ground and thereby no ricochets can occur.

The practice projectile can be easily constructed without difficulty as a non-spinning practice projectile.

What is claimed is:

1. A practice device having a sabot-driven sub-caliber fin-stabilized practice projectile, said device comprising:

(a) a sabot base, said sabot defining a longitudinal axis within a barrel, said sabot having;

(i) a passageway for propellant gas;

(ii) a longitudinally driven piston mounted within said sabot, said piston driven from a first position to a second position by propellant gas passing through said passageway;

(iii) first coupling means securing said piston to said sabot in a first position until a predetermined gas pressure is developed behind said piston to shear the first coupling and drive said piston from said first to said second position, (b) a sub-caliber fin-stabilized practice projectile mounted on said piston, said projectile having;

(i) a projectile shell having external fins;

(ii) a projectile head driven by said piston, and (iii) second coupling means for securing said projectile to said piston, said second coupling means being sheared by momentum imparted to said projectile head by the piston as it terminates its travel at its second position, whereby propellant gas expels the sabot from a barrel while simultaneously driving said piston from its first position to its second position and thereby launch the projectile by momentum imparted from said sabot and said piston.

2. A practice device as claimed in claim 1, said sabot base including a gas reduction nozzle.

3. A practice device as claimed in claim 1 or 2, wherein said projectile shell has a relatively low mass, and said projectile head has a displaceable, relatively high mass tubularly-shaped projectile head mounted for displacement within said shell; a third coupling fixing said projectile head in a first position; and means for limiting the path of displacement of said projectile head within the projectile shell longitudinal axis of said sabot.

4. A practice device as claimed in claim 3, wherein said third coupling is located between the projectile shell and displaceable projectile head, said third coupling being sheared by momentum imparted to said displaceable head by said piston before said second coupling is sheared.

5. A practice device as claimed in claim 3, wherein said projectile head is formed of a brittle material that readily fractures at impact against ground, said material being selected from the group consisting of sintered iron and glass-hard steel.

6. A practice device as claimed in claim 3, wherein said projectile shell is formed of a light-weight deformable material, such as aluminum.

7. A practice device as claimed in claim 4, comprising a first collar on said projectile head and a second collar on said projectile shell to fixedly interconnect said projectile head with said projectile shell after said head has been displaced.

* * * * *

UNITED STATES PATENT AND TRADEMARK OFFICE

CERTIFICATE OF CORRECTION

PATENT NO. : 4,430,943

DATED : February 14, 1984

INVENTOR(S) : Erich Bock et al.

It is certified that error appears in the above-identified patent and that said Letters Patent is hereby corrected as shown below:

Column 1, line 22, "cartridge case" should read -- sabot --.

Signed and Sealed this

*Eighteenth* Day of *September 1984*

[SEAL]

*Attest:*

GERALD J. MOSSINGHOFF

*Attesting Officer*

*Commissioner of Patents and Trademarks*